US006121737A

United States Patent [19]

Guenther et al.

[11] Patent Number: 6,121,737

[45] Date of Patent: Sep. 19, 2000

[54] CEILING MOUNTED PROCESSOR SYSTEM

[75] Inventors: John L. Guenther, Aptos; Donald D. Campbell; Brian D. Perry, both of San Jose, all of Calif.

[73] Assignee: Compaq Computer Corporation, Cupertino, Calif.

[21] Appl. No.: 09/326,119

[22] Filed: Jun. 4, 1999

[51] Int. Cl.[7] ..... E04C 2/52

[52] U.S. Cl. ..... 318/266; 318/468; 318/16; 248/320; 254/362

[58] Field of Search ..... 318/16, 264, 265, 318/266, 283, 286, 466, 468; 52/220.1, 220.6; 248/317, 320, 323, 324, 327, 328; 254/362

[56] References Cited

U.S. PATENT DOCUMENTS 5,261,645 11/1993 Huffman ..... 254/267
5,352,033 10/1994 Gresham et al. ..... 312/312
5,366,203 11/1994 Huffman ..... 254/362
5,680,820 10/1997 Randolph ..... 108/25
5,911,661 6/1999 Murray et al. ..... 52/220.6

*Primary Examiner*—Bentsu Ro
*Attorney, Agent, or Firm*—Daniel D. Tagliaferri; Townsend and Townsend and Crew, LLP

[57] ABSTRACT

The present invention provides a processing system for coupling to an infrastructure of a building. The processing system comprises a processor having a plurality of processing system elements. A tray is coupled to the processor and the tray has at least one pivotal attachment member coupled to an articulating arm. A motor is coupled to a portion of the infrastructure and the articulating arm so that the motor may move the processing system between a first position and a second position.

19 Claims, 5 Drawing Sheets

CEILING MOUNTED PROCESSOR SYSTEM

FIELD OF THE INVENTION

The present invention relates generally to processing systems, and more particularly, to a processing system coupled to an infrastructure of a building.

BACKGROUND OF THE INVENTION

Computer systems are now common in both home and office environments. A typical home or office computer system may consist of a number of interconnected components such as a processing module, a display unit and user input devices. The processing module generally includes a central processing unit (CPU), memory, peripheral interfaces, power supplies and a cooling system. The cooling system, in many cases, may be a fan assembly which moves air through the processing module to cool the electrical components. The display unit may consist of a video display or a printer and the user input devices may include a keyboard and/or a mouse.

In a typical office environment, computer systems are generally located in the same room as the people using them. Even in networked environments, where a central computer server is used, each user will generally have a dedicated computer system which may act as both a terminal for accessing the central system, and as a stand alone processing system to meet the user's individual needs.

Widespread use of computers in office environments has led to a number of problems. First, the availability of space in many office environments is a major concern. Computer systems take up valuable office space which could otherwise be used for employees. For example, an office with ten employees may have computer hardware for each employee and additional hardware for computer peripherals such as printers. This means that a significant portion of the available office space is dedicated for the office computer hardware. Second, office building power systems have become large and more complex. With the number of computer systems in the office environment increasing, more electrical connections are required. This means more power outlets, more cabling, and even access to different power systems may be required to provide adequate power access for each room within a single building. Third, greater demands are placed on building cooling systems. Computers require a temperature and humidity controlled environment to operate properly. Thus, each room in the building may need to be cooled to accommodate the large numbers of computers and their associated hardware. This may result in room environments that may be uncomfortable for office workers. Additionally, the cost of cooling large office spaces may become prohibitive. Fourth, significant office noise can be created by the fan assemblies in the individual computers which can also pose a big problem.

In view of the foregoing problems, what is needed is a computer system that can be used in an office environment that will efficiently use the space, power and cooling systems available within the infrastructure of the building. The computer system should couple directly to the building infrastructure and have a mounting mechanism that allows the computer system to be located in the ceiling, walls or other portions of the building. This would save valuable office space. Access to the computer system should be convenient and easy allowing maintenance and servicing as needed. The computer system should couple into the building's power system thereby reducing the need for complex and expensive building power systems. The computer system should also couple into the building's cooling system thereby reducing the noise generated by numerous in-office computers and the expense of cooling an entire office spaces solely because of the operating requirements of the computers therein. The computer system should provide the capability to handle multiple users, wherein each user operates a simple work terminal, thereby reducing the number of computer work stations required within any given office space and resulting in further cost and space savings.

SUMMARY OF THE INVENTION

The present invention provides incorporating a processing system in an infrastructure of a building. The processing system comprises a processor having a plurality of processing system elements carried by a tray. The tray has at least one pivotal attachment member coupled to an articulating arm. A motor is coupled to a portion of the infrastructure and the articulating arm so that the motor may move the tray between a first position, that places the processing system in an undisturbed position for operation, and a second position, that exposes the processing system for access thereto.

DESCRIPTION OF THE SPECIFIC EMBODIMENTS

Figure 1:
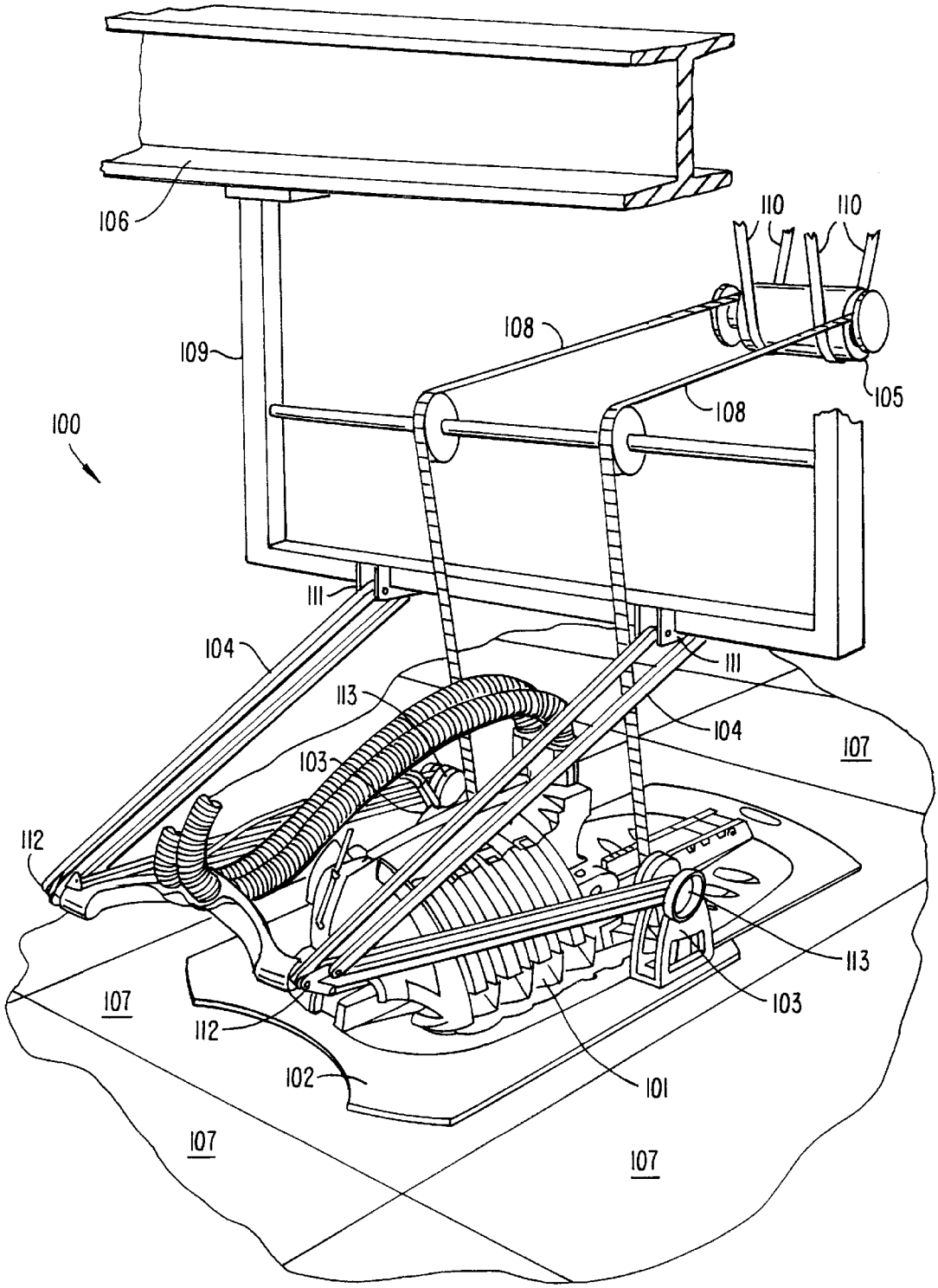
FIG. 1 illustrates a processing system constructed in accordance with the resent invention and shown in a retracted position.

FIG. 1 illustrates a processing system 100 constructed according to the teachings of the present invention. The processing system 100 comprises a processor 101, a tray 102, pivot arms 103, articulating arms 104 and a motor 105. The processing system 100 is shown coupled to an infrastructure portion 106 of a building by a support member 109. The infrastructure portion 106 is located above a suspended ceiling portion 107 of a room of the building. The suspended ceiling portion 107 may be comprised of suspended acoustical tile which are visible to those in the room below. The processing system 100 of FIG. 1 is shown in a first or retracted position, wherein the tray 102 is at the level of the suspended ceiling portion 107, so that from the room below the suspended ceiling appears to be a continuous surface. This position locates the processing system in the ceiling, removing it from the work space of the room (not shown) covered by the ceiling.

The motor 105 is mounted to the building's infrastructure by mounting members 110. A set of cables 108 couple the motor to the pivot arms 103 and the articulating arms 104 allowing the entire processing system 100 to move when the motor either takes in or pays out the cables 108. The motor receives power from the building power system and may be remotely controlled so that a user may activate and deactivate the motor using a remote control device (not shown).

The articulating arms 104 have pivoting attachment joints 111 which attach to the support member 109. The articulating arms also have moveable knee joints 112 and pivot connecting joints 113, wherein the pivot connecting joints are coupled to the pivot arms 103. The articulating arms, with their associated pivoting joints and knees, allow the processing system to be moved in a stable fashion between the retracted position and an extended position when the motor 105 takes in or pays out the cables 108 respectively.

Figure 2:
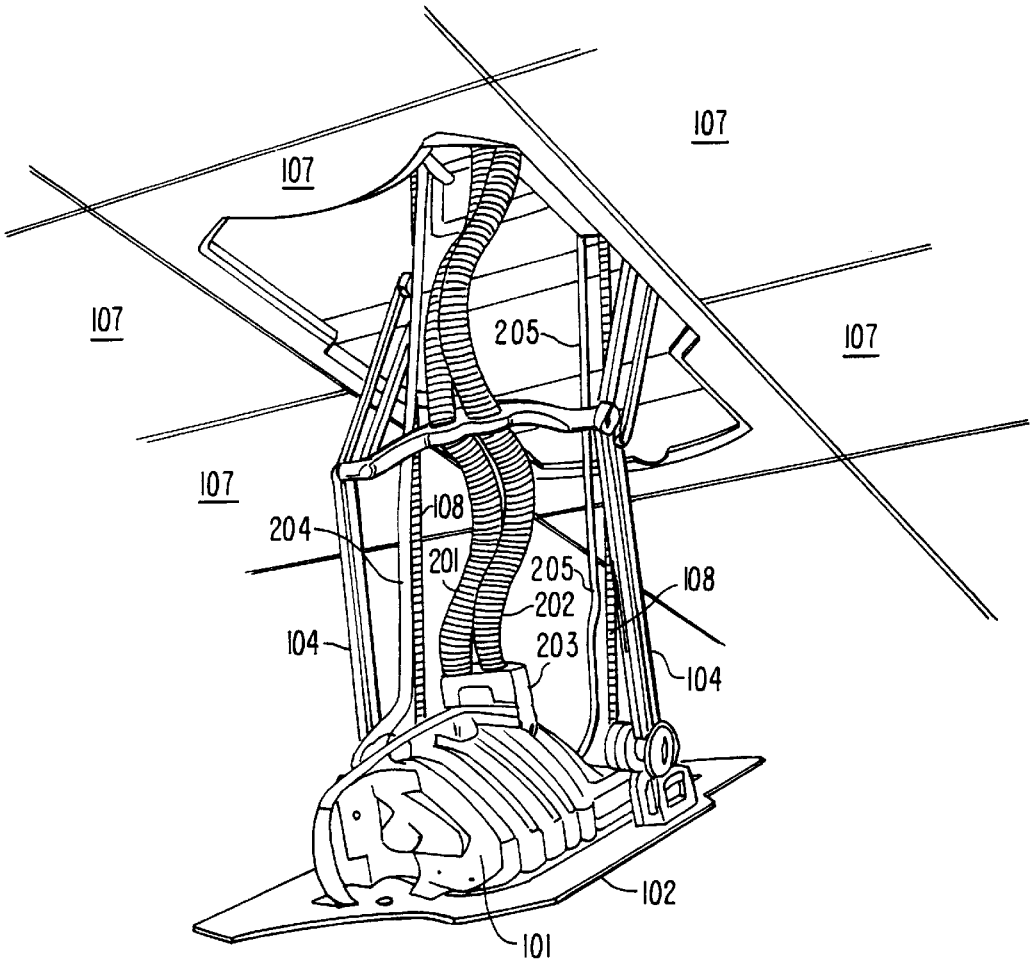
FIG. 2 illustrates the processing system of FIG. 1 shown in an extended position.

FIG. 2 illustrates the processing system 100 in a second or extended position. In the extended position, the processing system 100 become accessible to users in the room below. To get to the extended position, the tray 102 is moved to a position below the level of the suspended ceiling 107 by the operation of the motor 105 paying out the cables 108 and thus extending the articulating arms 104. A cooling input conduit 201 and a cooling output conduit 202 are shown coupled to the processor 101 at manifold 203. The cooling conduits 201 and 202 are coupled to the building's cooling system (not shown) to allow the building's cooling system (e.g. those components of a cooling system normally found in ceiling passages of buildings) to cool the components of the processor 101. The cooling input conduit 201 provides cool air to the processor from the building's cooling system, while the cooling output conduit 202 exhausts air from the processor to the building's cooling system.

A power conduit 204 (not shown in FIG. 1 for clarity) connects the processor 101 with the building power system (not shown) to provide power to the processor 101 and its associated components. A power converter, also not shown, may be used to couple the building's power system to the power conduit, so that the building's power may be converted to a form usable by the processor 101. For example, the building's power system may provide high voltage AC power and the converter may convert this to low voltage DC power for use by the processing system.

A communications conduit 205 is used to connect the processing system to the users. The users may interact with the processing system via work terminals that may comprise, for example, compact video terminals and keyboards. The communications conduit may contain individual cabling connecting each user work terminal to the processing system. The communications conduit may also contain multiplexed cabling wherein signals associated with two or more work terminals are multiplexed onto a single cable for connection to the processing system. The multiplexed signals may be multiplexed together via a multiplexing unit (not shown) which can be located between the user work terminals and the processing system. A further alternative is to use wireless (e.g. IR of RF) to communicate between the processor 101 and user components (i.e., terminals, workstations, printer, etc.—not shown).

The cooling conduits 201 and 202, the power conduit 204 and the communication conduit 205 all are of sufficient length to provide strain relief so that when the processing system is moved between the retracted position and the extended position, the respective conduits are not strained or damaged from being pulled or stretched. In another embodiment, the conduits may be constructed of expandable material thereby allowing small amounts of stretching to be accommodated.

Controlling the movement of the processing system 100 may be accomplished via user controls that may include a hardwired controller (not shown) located in the same room as the processing system 100. The hardwired controller may also be located in another room for security reasons, so that access to the processing system can be achieved only by authorized persons. The movement of the processing system may also be controlled by a remote control device (not shown) which operates, for example, via radio frequencies or infrared frequencies, so that the remote control device may be carried from room to room to access a number of processing systems. Access to the systems may also be security encoded so that a specific remote control device or a specific access code is required to access a specific processing system.

Upon activation of the controller device, either hardwired or remote, the processing system will move between the retracted position and the extended position. If the processing system is already in the extended position, activation of the control device will cause the processing system to move to the retracted position and vice versa. Thus, the processing system may be raised to the ceiling level or lowered to a level accessible by users in the room below, based on operation of the control device. Retracting the processing system to the ceiling level provides quiet operation and more available office space. Lowering the processing system to the extended position facilitates access to the processing system for upgrades and maintenance.

Figure 3:
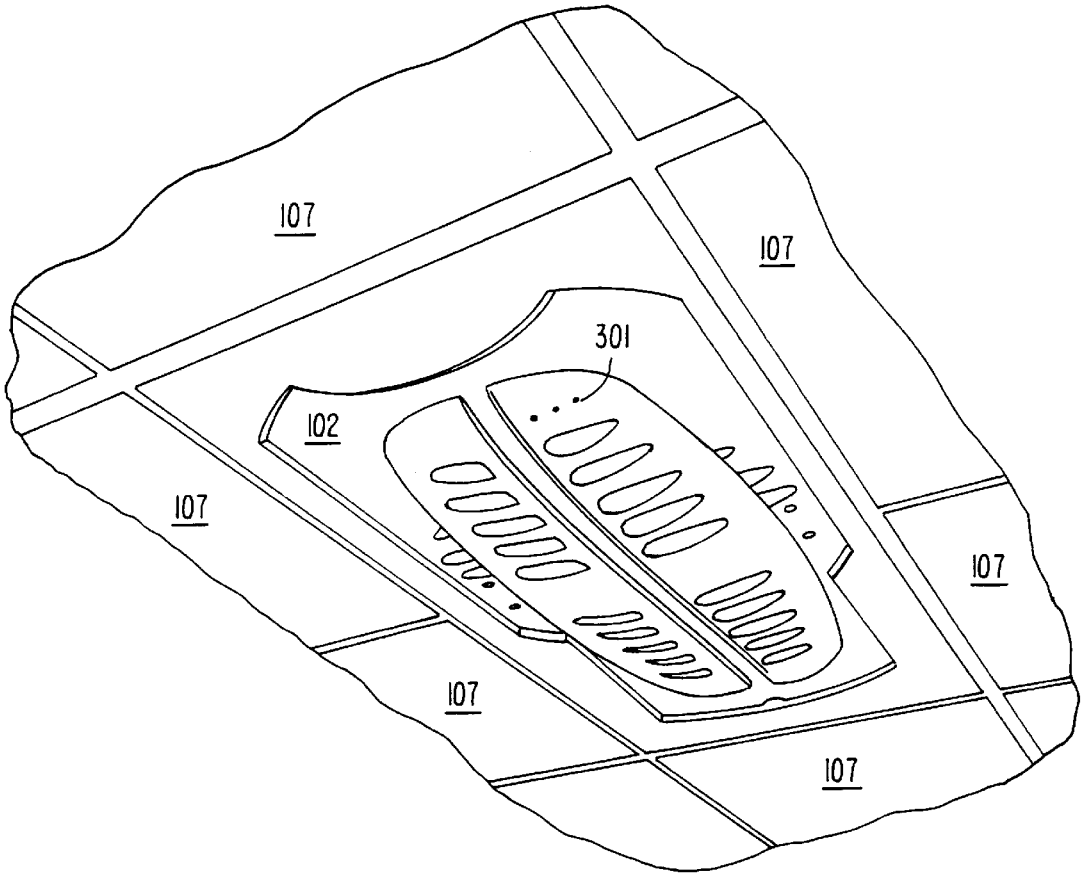
FIG. 3 illustrates another view of the processing system of FIG. 1 shown in the retracted position.

FIG. 3 illustrates the processing system in the retracted position as viewed from the room below. The bottom of the tray 102 forms a portion of the suspended ceiling so that the ceiling and the tray form a continuous surface. Additionally, operating indicators 301, which may be connected to the processing system, can be coupled to the tray so that a person in the room below may look up to view a status of the processing system. The status may be, for example, a power status, cooling status or a status related to the operation of the processing system. In the retracted position, the processing system does not interfere with use of the room by users since it is in a position adjacent with the suspended ceiling and thus completely out of the way.

Figure 4:
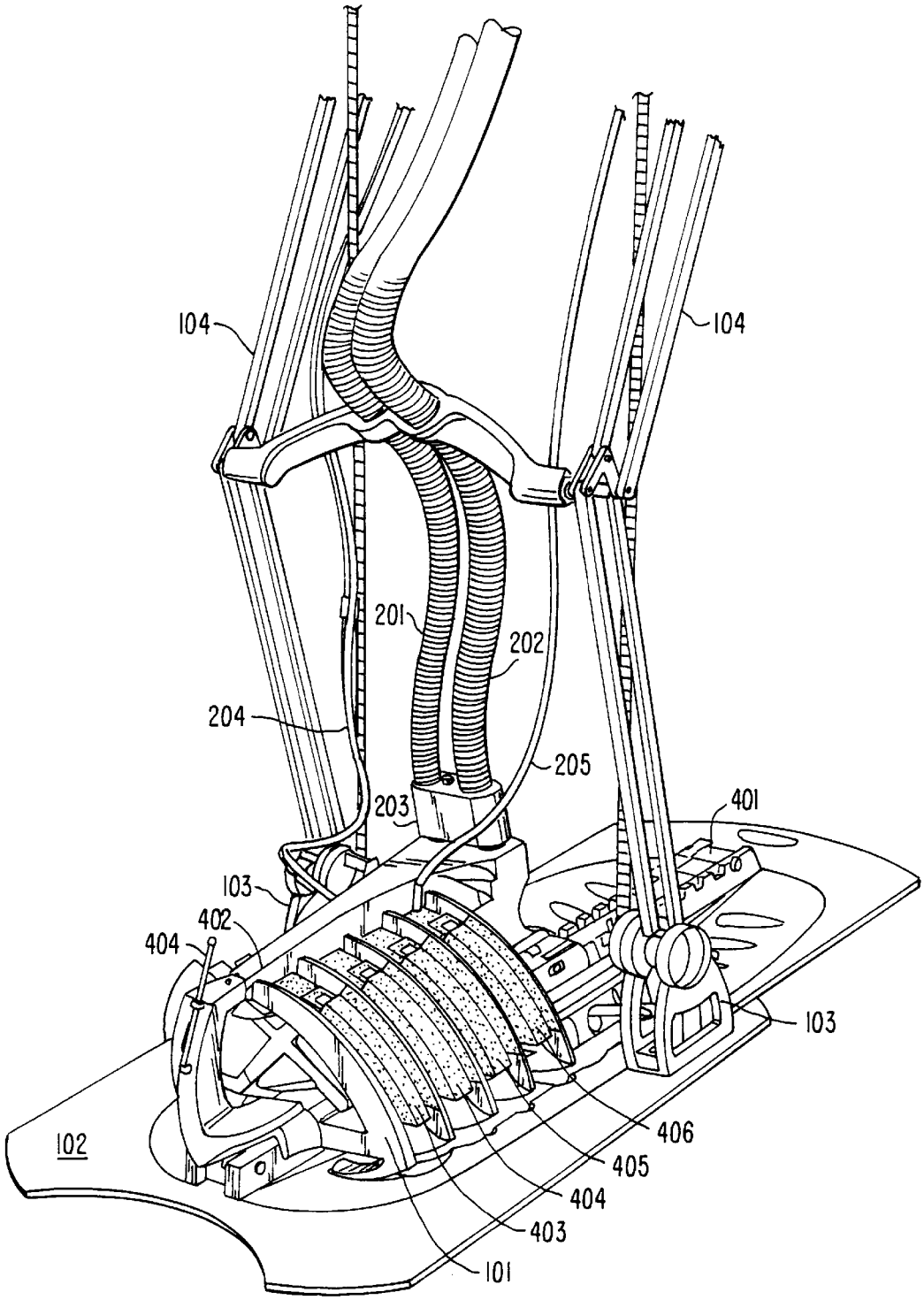
FIG. 4 illustrates a processor for use with the processing system of FIG. 1.

FIG. 4 illustrates a detailed view of the processor 101. The processor 101 comprises a backbone 401, a rib cage 402 and processing elements 403, 404, 405 and 406. Also shown in the detailed view are the tray 102, the pivot arm 103, the articulating arms 104, the power conduit 204, the communications conduit 205 and the cooling conduits 201 and 202. The processing elements 403, 404, 405 and 406 may comprise CPU, memory or other peripheral devices and are provided on plug in circuit assemblies. The processing elements plug into the rib cage and further connect to the backbone. The backbone is connected to the power conduit and provides power and communications to the processing elements via the rib cage. The rib cage 402 is coupled to the cooling conduits at manifold 203 and the rib cage has air passage ways that allow the distribution of air to/from the cooling conduits to the processing elements. Also shown is an antenna 404 which is used by the processor 101 to wirelessly send and receive information, such as commands to raise and lower the tray or to communicate with user components.

The communication conduit 205 connects the user work terminals to those processing elements that perform user interface functions. For example, the processing element 406 may be a user interface circuit assembly. In FIG. 4, the communications conduit is shown connected to the user interface circuit assembly represented by the processing element 406. The user interface circuit assembly may be capable of interfacing with one or more user work terminals to provide interaction between the user work terminals and the processor 101. Multiple user interface circuit assemblies can be plugged into the rib cage so that any number of user work terminals can be supported by the processor 101.

Figure 5:
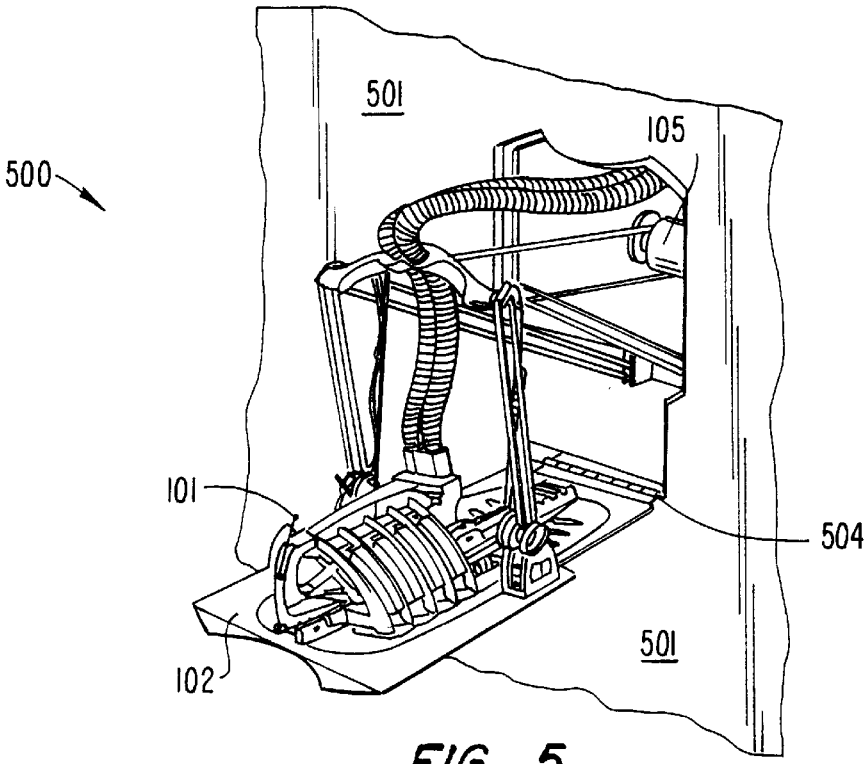
FIG. 5 illustrates another embodiment of a processing system constructed in accordance with the present invention.

FIG. 5 illustrates another embodiment 500 of the present invention. In some circumstances it may not be possible to couple the processing system 100 with the infrastructure of the building within the ceiling portion. The ceiling portion may be inaccessible or there simply may not be enough room available. In the embodiment 500 the processing system is shown coupled to the infrastructure of the building through a wall portion 501 of the room. By accessing the infrastructure through the wall portion, the processing system can still be moved to the extended position, as shown, where it is easily accessed if necessary.

The embodiment 500 comprises the processor 101, the tray 102, the pivotal arms, the articulating arms, the cables 108 and the motor 105. In addition, a flexible hinge 504 or flexible joint is used to couple the tray 102 to the wall portion 501. The hinge 504 allows the processing system to fold up and down with respect to the wall portion. In FIG. 5 the embodiment 500 is shown in the extended position wherein the processing system is accessible to users for upgrade and maintenance. Operation of the embodiment 500 is similar to the operation of the embodiment 100 of FIG. 1. When the motor pays out the cables, the processing system extends and when the motor takes in the cables, the processing system retracts.

Figure 6:
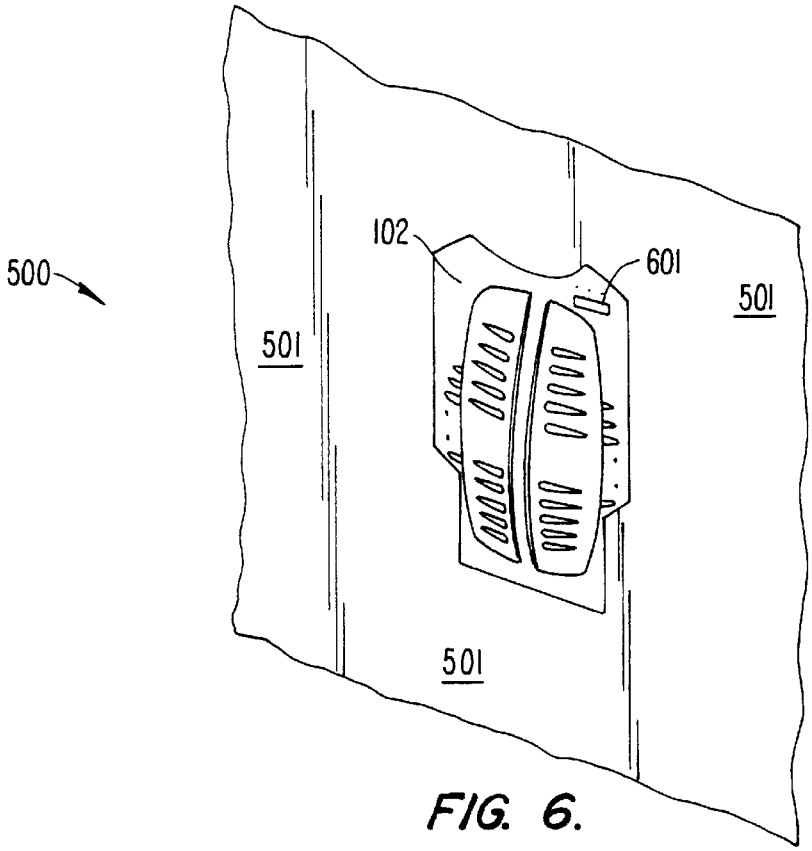
FIG. 6 illustrates another view of the processing system of FIG. 5.

FIG. 6 illustrates the embodiment 500 of the present invention in the retracted position. In the retracted position the tray forms a portion of the interior wall of the building so that no space in the room is required for the processing system. When in the retracted position, the underside of the tray is visible and so are status indicators 601 that may be used to convey the status of the processing system. The status indicators 601 may be simple indicator lights or may be a small display, such as an LCD display, capable of displaying text and graphical information relative to the status of the processing system, power system or cooling system.

As can be seen from the various embodiments, the processing system of the present invention allows for efficient use of the space, power and cooling capacity of an office building. In the extended position, the processing system is easily accessible by users for upgrades and maintenance. When in the retracted position, the processing system free up valuable office space and provides quiet operation by isolating the users from the noise associated with the operation of the cooling system. As will be understood by those familiar with the art, the present invention may be embodied in other specific forms without departing from the spirit or essential characteristics thereof. Accordingly, the disclosures and descriptions herein are intended to be illustrative, but not limiting, of the scope of the invention which is set forth in the following claims.

What is claimed is:

1. A processing system for coupling to an infrastructure of a building, said infrastructure including a power distribution system and a cooling distribution system, said processing system comprising:

a processor having a plurality of processing system elements;

a tray formed and configured to mount said processor, said tray having a first pivotal arm and a second pivotal arm;

an articulating arm structure coupled to said first pivotal arm and said second pivotal arm; and a motor mounted to the infrastructure and coupled to said articulating arm structure, said motor operating to move said tray between a first position and a second position.

2. The processing system of claim 1 wherein the infrastructure comprises a ceiling portion of the building.

3. The processing system of claim 2 wherein said first position is within said ceiling portion and said second position is below said ceiling portion.

4. The processing system of claim 1 wherein the infrastructure comprises a wall portion of the building.

5. The processing system of claim 4 wherein said first position is within said wall portion and said second position is a location disposed from said wall portion.

6. The processing system of claim 1 wherein said processing system further comprises a processor power system coupled to the power distribution system.

7. The processing system of claim 1 wherein said processing system further comprises a processor cooling system coupled to the cooling distribution system.

8. The processing system of claim 1 wherein said motor is remotely activated.

9. A processing system for coupling to an infrastructure of a building, said infrastructure including a power distribution system and a cooling distribution system, said processing system comprising:

a processor having a plurality of processing system elements;

a tray formed and configured to mount said processor, said tray having a first pivotal arm and a second pivotal arm;

a first articulating arm and a second articulating arm coupled to said first pivotal arm and said second pivotal arm respectively; and a motor mounted to the infrastructure and coupled to said first articulating arm and said second articulating arm, said motor operating to move said tray between a first position and a second position.

10. The processing system of claim 9 wherein said processor comprises a cage structure and wherein said plurality of processing elements plug into said cage structure.

11. The processing system of claim 10 wherein said tray comprises a backbone portion and said cage structure couples to said backbone portion.

12. The processing system of claim 10 wherein said cage structure comprises an air manifold and the cooling distribution system couples to said air manifold.

13. The processing system of claim 12 wherein said air manifold is coupled to said processing elements wherein the cooling distribution system cools said processing elements.

14. The processing system of claim 9 wherein said plurality of processing elements comprise a CPU, memory and a device driver.

15. The processing system of claim 14 wherein at least one user terminal is coupled to said device driver so that said at least one user terminal may interact with said processing system.

16. The processing system of claim 9 wherein a status indicator is coupled to said tray and said processor.

17. The processing system of claim 9 wherein said motor further comprises a cable assembly coupled to said first articulating arm and said second articulating arm, wherein said motor moves said cable assembly to move said tray between said first and said second positions.

18. The processing system of claim 9 wherein the infrastructure comprises a ceiling portion of the building, and said first position is within said ceiling portion and said second position is below said ceiling portion.

19. The processing system of claim 9 wherein the infrastructure comprises a wall portion of the building, and said first position is within said wall portion and said second position is a location disposed from said wall portion.

* * * * *